United States Patent [19]

Hartzel et al.

[11] 4,080,227

[45] Mar. 21, 1978

[54] PYROTECHNIC FILLED MOLDING POWDER

[75] Inventors: Lawrence W. Hartzel, Dayton; George E. Kettling, Cincinnati, both of Ohio

[73] Assignee: The United States of America as represented by the United States Department of Energy, Washington, D.C.

[21] Appl. No.: 804,190

[22] Filed: Jun. 6, 1977

[51] Int. Cl.[2] ..... C06B 43/00

[52] U.S. Cl. ..... 149/22; 149/40; 149/42; 149/44; 149/85; 149/19.91

[58] Field of Search ..... 149/22, 40, 42, 44, 149/85

[56] References Cited

U.S. PATENT DOCUMENTS 3,475,237 10/1969 Lane et al. ..... 149/40 X

*Primary Examiner*—Stephen J. Lechert, Jr.

*Attorney, Agent, or Firm*—Dean E. Carlson; Dudley W. King; Robert Southworth, III

[57] ABSTRACT

The disclosure relates to thermosetting molding compounds and more particularly to a pyrotechnic filled thermosetting compound comprising a blend of unfilled diallyl phthalate molding powder and a pyrotechnic mixture.

10 Claims, No Drawings

PYROTECHNIC FILLED MOLDING POWDER

FIELD OF THE INVENTION

This invention relates to a composition of matter wherein a thermosetting molding powder is comprised of a pyrotechnic filled polymer formulation.

BACKGROUND OF THE INVENTION

In the pyrotechnic art it is often desired to formulate a composition with suitable mechanical properties as well as suitable burning characteristics. It is well known that loose powder pyrotechnic compositions may be consolidated using a strong adhesive with or without compression. Among the natural substances which have been used as binders are dextrins, gum arabic, casein, animal hide glue, shellac, rosin, asphalt, and wax. Also used as binders have been synthetic substances such as celluloid, polyester resin, polyvinyl acetate, polyvinyl chloride, silicone resins, and fluorinated polymers.

In certain situations it is desired that a member perform both structural and pyrotechnic functions. For example, in order to safeguard equipment against unauthorized tampering, a critical component may be molded of a pyrotechnic filled molding compound. Upon unauthorized tampering, a suitable mechanism will cause the critical component to ignite causing self destruction and denying further operation of the equipment.

Such pyrotechnic filled members have previously been fabricated from epoxy resins or epoxy resins combined with polyfunctional mercaptans. Previous pyrotechnic filled plastic systems have a number of problems. In some cases a volatile solvent must be allowed to evaporate; in others expensive machining and finishing steps must follow a molding step operation. Eliminating the solvent removal step will eliminate hazards from flash fires due to the ignition of solvent vapors. Eliminating the machining and finishing step will eliminate hazard of flash fires due to the ignition of loose pyrotechnic dust. Furthermore, in slow curing liquid pyrotechnic filled plastic systems, the filler powder may settle causing uneven distribution in the final product.

SUMMARY OF THE INVENTION

It is an object of this invention to provide a plastic composition for the production of articles with desired structural properties.

It is a further object of this invention to provide said articles with desired pyrotechnic properties to deny unauthorized use.

It is a further object of this invention to provide a composition suitable for producing said articles without the use of volatile solvents.

It is a further object of this invention to provide a composition adapted to producing articles not requiring subsequent machining and finishing operations.

It is a still further object of this invention to provide a composition which sets rapidly to preclude possible filler settling or segregation.

In accordance with the present invention there is provided a thermosetting pyrotechnic filled molding powder comprising a diallyl phthalate polymer and a pyrotechnic filler, a process for molding the powder, and products of the molding process.

DETAILED DESCRIPTION OF A PREFERRED EMBODIMENT OF THE INVENTION

The invention relates to a composition of matter adapted for use as a molding powder which comprises a diallyl phthalate molding powder filled with a pyrotechnic filler, the molding of said powder to produce articles of predetermined shape and possessed of predetermined mechanical and pyrotechnic properties. It has been found that the proportions of 50 volume percent unfilled molding powder and 50 volume percent pyrotechnic filler give satisfactory results. However, any mixture in the range of 35 volume percent molding powder and 65 volume percent pyrotechnic filler to 65 volume percent molding powder and 35 volume percent pyrotechnic filler may be used so that there is sufficient polymer present to impart the necessary molding behavior and structural properties to the finished product and so that there is sufficient pyrotechnic filler present to initiate and sustain burning when desired. It should be noted that in subsequent examples, although weight percent is used as a matter of convenience, because of the varying density of pyrotechnic mixtures, volume percent more accurately describes the scope of the invention.

The diallyl phthalate molding powder may be prepared by mixing diallyl phthalate prepolymer with diallyl phthalate monomer, a suitable dye such as Zulu Blue (for identification purposes), a suitable mold release agent such as calcium stearate, and a suitable polymerization catalyst such as t-butylperbenzoate in the presence of acetone solvent and then allowing the acetone to evaporate forming a pasty mass. The pasty mass is then milled on a roll mill, sheeted, allowed to cool, ground to pass a 100 mesh screen and then dried overnight in a forced air oven.

The unfilled diallyl phthalate molding powder is then blended with a pyrotechnic filler in a dry powder blending operation. In a preferred embodiment a pyrotechnic mix comprising 49.6 weight percent potassium perchlorate, 12.3 weight percent red lead oxide, 7.9 weight percent amorphous boron, and 7.8 weight percent calcium silicide was employed. What other suitable pyrotechnic fillers may be used will be apparent to those skilled in the art who will recognize that what particular pyrotechnic filler is used is dependent upon its thermal stability in the presence of the diallyl phthalate molding powder and the desired pyrotechnic properties of the final article such as ignition temperature and amount of heat released.

For convenience in molding, the filled molding powder may be pelletized by placing the blended powders in flexible tubing and pressurizing the exterior of the tubing in an isostatic press.

Either the pelletized or unpelletized filled powder may be pressed to final shape in a die of predetermined shape by either compression molding or transfer molding. It was found that a molding pressure of 6000 to 20,000 psi at a temperature of 300° to 350° F gave satisfactory results. What other conditions may be used will be apparent to those skilled in the art who will recognize that what particular conditions are chosen will depend on the particular die characteristics as well as the particular proportions of pyrotechnic powder and diallyl phthalate molding powder in the mix.

EXAMPLE I

Dapon 35 diallyl phthalate prepolymer (FMC Corp.), (482.5g), diallyl phthalate monomer (17.5g), Zulu Blue dye (Harshaw Chemical Co.) (1.3g), calcium stearate (10g), and t-butylperbenzoate (10g) were added slowly with mixing to one liter of acetone contained in a one gallon sigma blade mixer. When the mixture was completely blended, most of the acetone was removed under vacuum until a pasty mass remained. The paste was transferred from the mixer to a heated roll mill. The temperature of the rolls were 55° and 75° C, respectively. The mixture was milled until the mass reached 72° C, then sheeted from the mill and allowed to cool. The sheet was broken, ground in mortar and ball milled to pass a 100 mesh screen. The finished molding powder was dried overnight at 60° C in a forced air oven.

Unfilled diallyl phthalate molding powder (30g) as prepared above was sieved through a 100 mesh screen with amorphous boron powder (7.1g) and calcium silicide (7.1g). Potassium perchlorate (44.7g) and red lead oxide (11.1g) were similarly sieved in a separate operation. The two mixtures were then thoroughly blended in a Patterson-Kelly Vee-type blender. The blend was pelletized by packing the powder into polyvinyl chloride tubing, capping the ends, and pressing the tubes in an isostatic press at 15000 psi.

The pelletized molding powder was molded into predetermined shapes by hot pressing into dies in a 25 ton Drabert Press under the following general molding conditions:

| | |
|---|---|
| Transfer pressure | 6000–8000 psi |
| Back Barrel Temperature | 300° F |
| Front Barrel Temperature | 310° F |
| Holding Time Loading | 10 sec |
| Holding Time Transfer Pressure | 28 sec |
| Mold Residence Time | 3–4 min |

The physical characteristics of the articles produced were as follows:

| | |
|---|---|
| Tensile Strength | 2632 psi |
| Flexural Strength | 6643 psi |
| Modulus of Elasticity | $1 \times 10^6$ psi |
| Compressive Strength | 15,566 psi |
| Impact Strength | .42 ft lb/in notch |
| Mold Shrinkage | 0.006 in/in |
| Caloric Output | 730 cal/g |

The test pieces were thermally stable for 5 minutes in molten solder at 600° F but could be ignited with a match, burning with a smooth flame.

EXAMPLE II

A similar pyrotechnic molding composition was made from 30 parts by weight of unfilled diallyl phthalate molding powder and 70.2 parts by weight of a pyrotechnic mix comprising 22 parts by weight of titanium hydride and 45.7 parts by weight of potassium perchlorate. After molding, this composition has a caloric output of 735 cal/gm is equal in molding quality so that composition described in Example I.

EXAMPLE III

A similar pyrotechnic molding composition was made from 30 weight percent diallyl phthalate polymer and 70 weight percent of a pyrotechnic mix known as SM-23 Flare Northern (Celesco Industries) and comprising potassium perchlorate and zirconium-nickel alloy. After molding, this composition has a caloric output of 500 cal/gm.

EXAMPLE IV

A similar pyrotechnic molding composition was made from 30 weight percent diallyl phthalate polymer and 70 weight percent of a pyrotechnic mix known as SM-36 Flare Northern (Celesco Industries) and comprising potassium perchlorate and titanium. After molding, this composition has a caloric output of 710 cal/gm.

EXAMPLE V

A similar pyrotechnic molding composition was made from 18 parts by weight of unfilled diallyl phthalate molding powder and 82 parts by weight of a pyrotechnic mix comprising 14.6 parts by weight of magnesium and 71.7 parts by weight of lead dioxide. After molding, this composition has a caloric output of 447 cal/gm.

EXAMPLE VI

A similar pyrotechnic molding composition was made from 19.5 parts by weight of unfilled diallyl pythalate molding powder and pyrotechnic mix comprising 14.4 parts by weight of titanium and 71.7 parts by weight of lead dioxide. After molding, this composition has a caloric output of 279 cal/gm.

The various features and advantages of the invention are thought to be clear from the foregoing description. However, various other features and advantages not specifically enumerated will undoubtedly occur to those versed in the art, as likewise will many variations and modifications of the preferred embodiment illustrated, all of which may be achieved without departing from the spirit and scope of the invention as defined by the following claims.

We claim:

1. A moldable pyrotechnic composition for the manufacture of structural members comprising from about 35 to 65 volume percent thermosetting diallyl phthalate polymeric molding powder containing up to about 2 weight percent mold release compound, and from about 35 to 65 volume percent ignitable exothermic pyrotechnic filler comprising fuel and oxidizer.

2. The invention of claim 1 wherein the pyrotechnic filler comprises potassium perchlorate, red lead oxide, calcium silicide and amorphous boron.

3. The invention of claim 1 wherein the pyrotechnic filler comprises titanium hydride and potassium perchlorate.

4. The invention of claim 1 wherein the pyrotechnic filler comprises titanium and potassium perchlorate.

5. The invention of claim 1 wherein the pyrotechnic filler comprises potassium perchlorate and an alloy of zirconium and nickel.

6. The invention of claim 1 wherein the pyrotechnic filler comprises titanium and lead dioxide.

7. The invention of claim 1 wherein the pyrotechnic filler comprises magnesium and lead dioxide.

8. The moldable pyrotechnic composition of claim 1 wherein said composition is simultaneously heated to a temperature from about 300° to about 350° F and compressed from about 6000 psi to about 20,000 psi while confined in a die of predetermined shape.

9. The moldable pyrotechnic composition of claim 1 comprising thermosetting diallyl phthalate polymeric molding powder containing up to about 2 weight percent calcium stearate, about 45 weight percent potassium perchlorate, about 11 weight percent red lead oxide, about 7 weight percent calcium silicide, and about 7 weight percent amorphous boron.

10. The moldable pyrotechnic composition of claim 1 comprising thermosetting diallyl phthalate polymeric molding powder containing up to about 2 weight percent calcium stearate, about 23 weight percent titanium hydride, and about 47 weight percent potassium perchlorate.

* * * * *